US012601095B2

(12) United States Patent
Morrow et al.

(10) Patent No.: US 12,601,095 B2
(45) Date of Patent: Apr. 14, 2026

(54) LAUNDRY TREATING APPLIANCE

(71) Applicant: WHIRLPOOL CORPORATION, Benton Harbor, MI (US)

(72) Inventors: Bradley D. Morrow, Stevensville, MI (US); David G. Quante, St. Joseph, MI (US); Philip R. Thompson, Alvada, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 337 days.

(21) Appl. No.: 18/128,558

(22) Filed: Mar. 30, 2023

(65) Prior Publication Data

US 2024/0328053 A1 Oct. 3, 2024

(51) Int. Cl.

| | |
|---|---|
| ***D06F 25/00*** | (2006.01) |
| ***D06F 37/26*** | (2006.01) |
| ***D06F 39/08*** | (2006.01) |
| ***D06F 39/12*** | (2006.01) |
| *D06F 58/24* | (2006.01) |

(52) U.S. Cl.

CPC ..... *D06F 25/00* (2013.01); *D06F 37/268* (2013.01); *D06F 39/088* (2013.01); *D06F 39/125* (2013.01); *D06F 58/24* (2013.01)

(58) Field of Classification Search

CPC ..... D06F 25/00

See application file for complete search history.

(56) References Cited

U.S. PATENT DOCUMENTS

| | | | |
|---|---|---|---|
| 5,855,127 | A | 1/1999 | Kohara et al. |
| 9,951,457 | B2 | 4/2018 | Hunnell et al. |

FOREIGN PATENT DOCUMENTS

| | | | |
|---|---|---|---|
| CN | 201864968 | U | 6/2011 |
| CN | 215405130 | U | 1/2022 |
| WO | 2007000035 | A1 | 1/2007 |

*Primary Examiner* — Jason Y Ko

(74) *Attorney, Agent, or Firm* — McGarry Bair PC

(57) ABSTRACT

A clothes washer comprising a cabinet defining a cabinet interior. A tub is located within the cabinet interior and defines a liquid chamber having access via a tub opening. A suspension couples the tub to the cabinet. A basket is located within the liquid chamber and defines a basket interior, which defines at least a portion of a treating chamber. The basket has an open top upon which the balancing ring is mounted. An extension is coupled to the balancing ring to increase the volume or capacity of the treating chamber.

19 Claims, 4 Drawing Sheets

LAUNDRY TREATING APPLIANCE

BACKGROUND

Laundry treating appliances, such as washing machines, combination washer/dryers, condensing dryers, refreshers, and non-aqueous systems, can have a configuration based on a rotating laundry basket or drum that defines a drum opening and at least partially defines a treating chamber in which laundry items are placed for treating. The drum can be provided within an interior of a tub that defines a tub opening and further can at least partially define the treating chamber. The laundry treating appliance can have a controller that implements a number of user-selectable, pre-programmed cycles of operation having one or more operating parameters. Hot water, cold water, or a mixture thereof, along with various treating chemistries, can be supplied to the treating chamber in accordance with the cycle of operation.

BRIEF SUMMARY

The invention relates to a clothes washer comprising a cabinet defining a cabinet interior. A tub is located within the cabinet interior and defining a liquid chamber having a tub access opening. A suspension couples the tub to the cabinet. A basket is located within the liquid chamber and defines a laundry treating chamber having a basket access opening. A balancing ring circumscribes the basket access opening. An extension collar circumscribes at least a portion of the balancing ring and projects beyond the balancing ring to increase an effective volume of the basket.

A clothes washer comprising a cabinet defining a cabinet interior and a tub located within the cabinet interior and defining a liquid chamber having a tub access opening. A container is located within the liquid chamber and defines at least a part of a laundry treating chamber having a basket access opening. A non-balancing extension collar coupled to the container to increase an effective volume of the laundry treating chamber.

DETAILED DESCRIPTION

Figure 1:
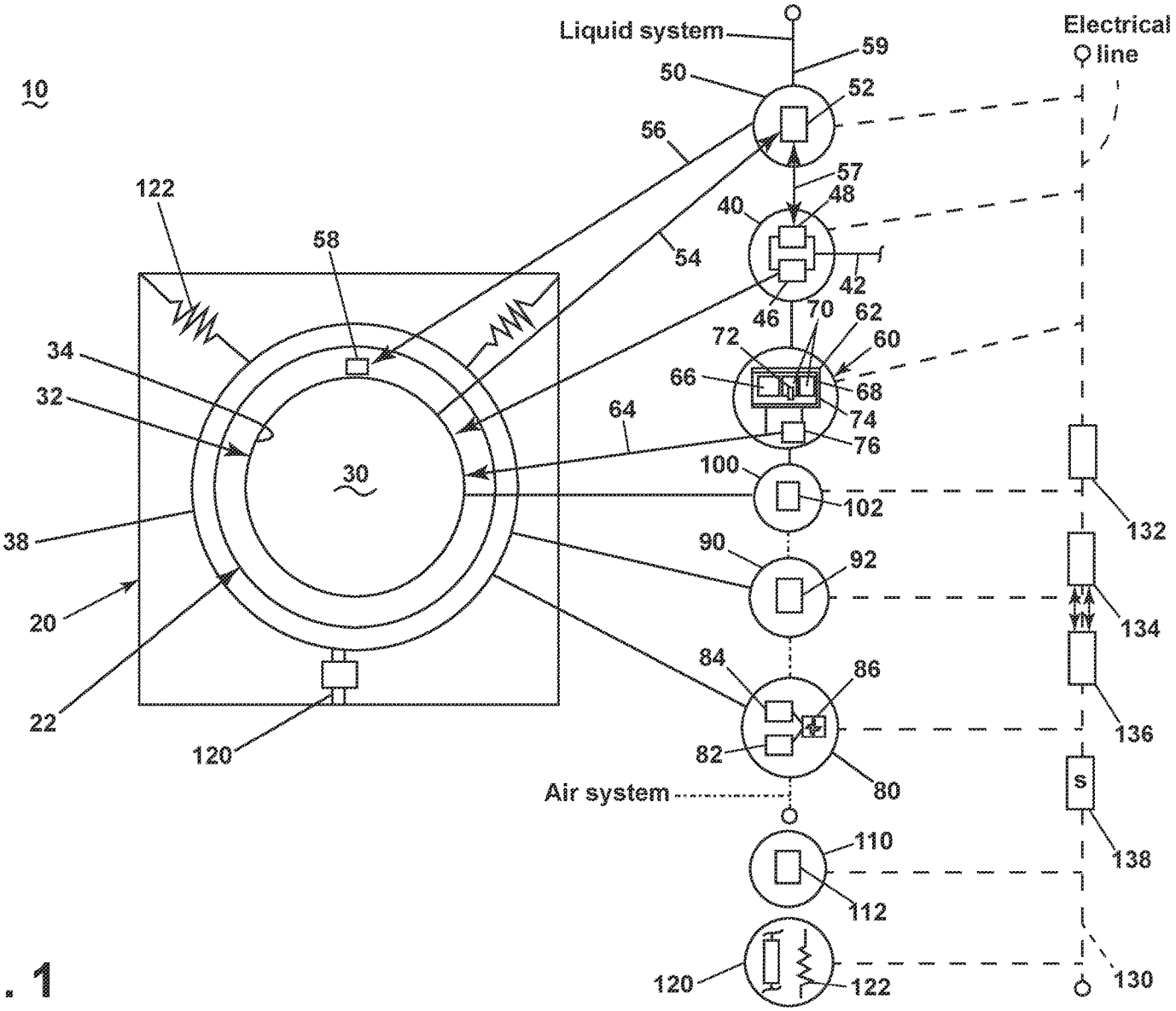
FIG. 1 illustrates a schematic view of a laundry treating appliance including a moisture removing system.

FIG. 1 illustrates a laundry treating appliance 10 including a cabinet 20 in which a treating chamber 30 is located, along with a plurality of systems, with one or more of the systems controlled by a controller 130 to carry out a treating cycle of operation on laundry within the treating chamber 30. Examples of such laundry treating appliances 10 include, without limitation, clothes washer (washer), clothes dryer (dryer), combination washer/dryer (combo), and/or refreshers. Different combinations of the systems can be used depending on the type of laundry treating appliance 10.

The cabinet 20 can include a closure 22 that selectively provides access to the treating chamber 30. The closure 22 can vary depending on the type and configuration of the laundry treating appliance 10. For front-loading laundry treating appliances, the closure can be a door moveably mounted relative to a front of the cabinet 20. For top-loading appliances, the closure can be a lid moveably mounted to a top of the cabinet 20. In a drawer-type appliance, the closure is the cabinet that a drawer slides in and out of. In some configurations, the closure can extend over at least a portion of both the top and front of the cabinet 20. The cabinet 20 can be implemented by a chassis or frame to which a variety of panels (front, back, left, right, and top) are mounted, with the panels forming the cabinet exterior.

The treating chamber 30 can be a container 32 defining an access opening 34, which is selectively closed by the closure 22. The container 32 can be oriented in the cabinet 20 such that the access opening 34 faces one or more sides of the cabinet 20. For front-loading appliances, the access opening 34 generally faces a front of the cabinet 20 and for top-loading appliances, the access opening 34 generally faces a top of the cabinet 20. The container 32 can be stationary or it can move, such as by translating, rotating, or reciprocating, for example.

The container 32 can be configured to hold liquid, such as in a dryer-only configuration or a low-pressure dryer. The container 32 can also be configured to let liquid pass through, such as by having a series of perforations, such as in a clothes washer or a combo washer/dryer. In a liquid pass-through configuration, the container 32 can be located partially or completely within a liquid holding tub 38, which catches the liquid after passing through the container 32. In a vertical axis clothes washer, the container is often referred to as a basket, and in a horizontal axis clothes washer, the container is often referred to as a drum.

The container 32, alone, or in combination with the tub 38, can be sealed, including the closure 22, relative to atmosphere to provide a low-pressure chamber, i.e. lower than ambient pressure, suitable for a low-pressure drying cycle, where the pressure inside the treating chamber 30 is dropped, relative to the ambient pressure, a sufficient amount to effect a flash drying of the liquid. Such a scaling need not be a perfect seal as the low pressure need not be a vacuum to affect a flash drying.

The different systems can include a water system 40, which receives water from a household water supply line 42 and supplies the water to other systems and/or the treating chamber 30 along water supply lines 44. The water system 40 can optionally include a water treater 46 and a water tank 48. The water treater 46 can treat the water from the household water supply line 42 and then supply the treated water to the tank 48, the systems, or the treating chamber 30. The water treater 46 can be a water softener, an ionizer, etc. The tank 48 can be cither or both a supply tank or a reuse tank. As a supply tank, the tank 48 stores water from the household water supply and supplies it as demanded. For convenience, the tank 48 can be sized such that it holds a predetermined volume of water that corresponds to a volume contemplated for use in the laundry treating appliance 10, which can be referred to as a "charge" of water. As a reuse tank, the tank 48 stores water that is used in a treating cycle of operation, which means the stored water may, but not necessarily, include chemicals, such as detergents, softeners, etc., and can be described as a wash liquid. The tank 48 can be located near or in abutting contact with the treating chamber 30 such that heat from the treating chamber 30 is transferred to the tank 48 and any contents within the tank 48.

A recirculation system 50 can recirculate liquid from the treating chamber 30 back to the treating chamber 30. To accomplish the recirculation, the recirculation system 50 can include at least one pump 52, which draws liquid from the treating chamber 30, through a return line 54, such as from the container 32 or tub 38, and returns it, through a re-supply line 56, to the treating chamber 30, such as through a nozzle 58. The nozzle 58 can be in the form of a plain tube and/or a spray head, which may have a predetermined spray pattern. The return line 54 and re-supply line 56 can be thought of as a liquid recirculation circuit for the treating chamber 30.

Additional liquid lines can be provided to redirect the liquid as desired outside of the recirculation system 50. For example, a reuse line 57 can fluidly couple the output of the pump 52 to the tank 48, where the liquid may be stored for reuse in the current cycle of operation or for a future cycle of operation. A drain line 59 can be coupled to the pump 52 such that the output of the pump 52 is supplied to a household drain. In some configurations, the pump 52 can include multiple pumps, such as a drain pump and a recirculation pump, with the drain pump typically being more robust to handle foreign objects and other items that are not recirculated, but are removed down the drain.

A dispensing system 60 dispenses treating chemistry, directly or indirectly, into the treating chamber 30. The dispensing system includes a dispenser 62 that is connected to the treating chamber 30 by a conduit 64, such that chemistry dispensed from the dispenser 62 travels through the conduit 64 to the treating chamber 30. The dispenser 62 can have one or more sources 66 of treating chemistry, which can be either or both single-use or bulk sources of treating chemistry. Single-use sources will typically contain a single "charge" of treating chemistry that is fully dispensed over a cycle of operation, whereas bulk sources contain multiple charges of treating chemistry. In a single-use configuration, the source 66 can be a cup or other container that is manually filled or a cartridge that is replaced by the user. In a bulk-use configuration, the source 66 can be a container that is re-filled by the user or a container that is replaced after multiple cycles. Typically, the types of chemistries that might be dispensed include: detergent, fabric softener, bleach, and enzymes.

One configuration for the dispenser 62 is a drawer 68 within which are located one or more cups 70 having a fluid outlet, like a siphon 72. A housing 74 underlies the siphon 72 and is fluidly coupled to the treating chamber 30 by the conduit 64. The water system 40 and/or the recirculation system 50 supplies water to the cup 70, which floods the cup 70, causing the chemistry in the cup 70 to mix with the water and flow out the siphon 72. Alternatively, a pump 76 can fluidly couple the cup 70 directly to the conduit 64 and/or the treating chamber 30.

An air system 80 supplies air to the treating chamber 30. The supply of air can be one or both of a pass-through air supply circuit 82 or a recirculating air supply circuit 84. The air system 80 can include an air flower 86, such as a fan or blower, to flow air through the pass-through air supply circuit 82 or the recirculating air supply circuit 84.

A heating system 90 can be used to heat fluid, liquid, or air, used in the treating chamber 30. The heating system 90 can include one or more heaters 92, including a resistive heater, immersible or non-immersible, a heat pump, or a gas heater, for example. The heater 92 can be located in the tub 38, such as an immersion heater in a sump formed by the tub 38, or located in one of the pass-through or recirculating air supply circuits 82, 84. In some implementations, both an immersible heater can be used in the sump and a resistive or gas heater used inline in one or both of the air supply circuits 82, 84.

A moisture removing system 100 removes moisture from the treating chamber 30 and/or laundry located within the treating chamber 30. The moisture removing system 100 can combine the air system 80 and the heating system 90 to supply heated air to the treating chamber 30. The moisture removing system 100 can just supply heat to the treating chamber 30, without the supplying of air, and rely on natural convection air flow for moisture removal. The moisture removing system 100 can also just supply air, without the addition of heat, to the treating chamber 30. An optional condenser 102 can be provided to receive the naturally flowing air or the forced air from the air system 80 and condense moisture from the air passing through the condenser 102. The condenser 102 can be fluidly coupled to at least one of the water system 40 or the recirculation system 50 such that the condensate can be stored for reuse in the tank 48 or drained.

A movement system 110 is provided for imparting motion or mechanical energy to laundry within the treating chamber 30 or to the treating chamber 30. The motion can be rotational or linear in one or more axes. For example, in horizontal axis appliances, the container 32 can be rotated about a rotational axis to affect a lifting/dropping or tumbling of the laundry and thereby impart mechanical energy to the laundry, and, or in addition, the container 32 can be reciprocated in one or more of the three primary axes to also impart mechanical energy to the laundry. In vertical axis appliances, a clothes mover can reside within the treating chamber and impart mechanical energy to the laundry. The clothes mover can be one or more, alone or in combination, of an agitator, auger, impeller, wash plate, nutator, pulsator, just to name a few. These clothes movers can rotate, either clockwise (CW) or counterclockwise (CCW), or reciprocally rotate between the CW and CCW directions. The agitators can also reciprocate about an axis, which can be a rotational axis, where the clothes mover both rotates and reciprocates, or at least has one portion that rotates and another portion the reciprocates, as in a combination agitator with a pulsator.

The movement system 110 can be implemented with an electric motor 112 that is directly or indirectly coupled to the container 32 or clothes mover to drive the movement of the container 32 or clothes mover. In some implementations, the electric motor 112 can be directly mounted to the cabinet 20 and/or the tub 38 and connected to the container 32 or clothes mover via a drive shaft.

For purposes of this description, the terms horizontal axis and vertical axis are used to represent the general orientation of the axis of rotation and is not meant to be limited to a perfectly horizontal or perfectly vertical axis of rotation. The terms horizontal axis of rotation or vertical axis of rotation, when used to identify the type of laundry treating appliance, are more accurately used to describe the primary mechanism by which mechanical energy is imparted to the laundry. The horizontal axis washing machine imparts mechanical energy primarily by tumbling the laundry within the drum (container). That is, rotation of the drum lifts and then drops the laundry. This lifting/dropping imparts mechanical energy to the laundry. The vertical axis washing machine imparts mechanical energy via a clothes mover located in the basket (container), such as an agitator, impeller, pulsator, auger, etc., which is rotated within the basket to effect movement of liquid in the basket or directly impact the laundry. While a laundry container is normally referred to as a drum for a horizontal axis machine and a basket for a vertical axis machine, for this disclosure, unless otherwise stated, drum and basket are interchangeable. Additionally, while most horizontal axis clothes washers are front loading and most vertical axis clothes washers are top loading, that need not be the case. Horizontal axis clothes washers can be top loaders, and typically have a door in the side of the drum. Vertical axis clothes washers can have a lid that extends into the front of the cabinet.

A suspension system 120 can be used to support one or more of the components of the movement system 110 or other system components, which are moved by the movement system 110. For example, one or more suspension components can support the tub 38 and/or container 32 relative to the cabinet 20. The suspension components can include one or more springs 122 and/or dampeners 124 coupling the tub 38 or container 32 to the cabinet 20. The spring 122/dampener 124 can be combined into a single device like a shock absorber. One implementation is for springs 122 to suspend an upper portion of the tub 38 from the cabinet 20 or a frame within the cabinet 20 in combination with a dampener 124 coupling a lower portion of the tub 38 to a floor of the cabinet 20.

A controller 130 is operably coupled to the various systems and their components to control the operation of the laundry treating appliance 10 and its various working systems to control the operation of the working systems and to implement one or more treating cycles of operation. A user interface 132 is operably coupled with the controller 130. The user interface 132 can provide an input and output function for the controller 130. The user interface 132 can be provided or integrated with the closure 22 or can be provided on the cabinet 20.

The user interface 132 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 130 to communicate with the user in a variety of ways. For example, the controller 130 can be configured to send a text message to the user, send an electronic mail to the user, or provide audio information to the user either through the laundry treating appliance 10 or utilizing another device such as a mobile phone.

The controller 130 can include the machine controller and any additional controllers provided for controlling any of the systems of the laundry treating appliance 10. For example, the controller 130 can include the machine controller and a motor controller. Many known types of controllers can be used for the controller 130. It is contemplated that the controller is a microprocessor-based controller that implements control software and sends/receives one or more electrical signals to/from each of the various working systems to affect the control software. As an example, proportional control (P), proportional integral control (PI), and proportional derivative control (PD), or a combination thereof, a proportional integral derivative control (PID control), can be used to control the various systems.

The controller 130 can be provided with a memory 134 and a central processing unit (CPU) 136. The memory 134 can be used for storing the control software that is executed by the CPU 136 in completing a cycle of operation using the laundry treating appliance 10 and any additional software. For example, the memory 134 can store a set of executable instructions including at least one user-selectable cycle of operation. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 132. The memory 134 can also be used to store information, such as a database or table, and to store data received from one or more systems of the laundry treating appliance 10 that can be communicably coupled with the controller 130. The database or table can be used to store the various operating parameters for the one or more cycles of operation, including factory default values for the operating parameters and any adjustments to them by the control assembly or by user input.

The controller 130 can be operably coupled with one or more systems of the laundry treating appliance 10 for communicating with and controlling the operation of the systems to complete a cycle of operation. For example, the controller 130 can be operably coupled with the water system 40 for controlling the temperature and flow rate of treating liquid into the treating chamber 30, the motor 112 for controlling the direction and speed of rotation of the container 32, the pump 52 for controlling the amount of treating liquid in the treating chamber 30 or sump, the dispenser 62 for controlling the flow of treating chemistries into the treating chamber 30, the user interface 132 for receiving user selected inputs and communicating information to the user, and the heater 92, the moisture removing system 100, including the air flower 86 and the heating system 90, to control the operation of these and other systems to implement one or more of the cycles of operation.

The controller 130 can also be coupled with one or more sensors 138 provided in one or more of the assemblies of the laundry treating appliance 10 to receive input from the sensors 138, which are known in the art and not shown for simplicity. Non-limiting examples of sensors 138 that can be communicably coupled with the controller 130 include: a treating chamber temperature sensor, such as a thermistor, which can detect the temperature of the treating liquid in the treating chamber 30 and/or the temperature of the treating liquid being supplied to the treating chamber 30, a moisture sensor, a weight sensor, a chemical sensor, a position sensor, an imbalance sensor, a load size sensor, and a motor torque sensor, which can be used to determine a variety of assembly and laundry characteristics, such as laundry load inertia or mass.

Figure 2:
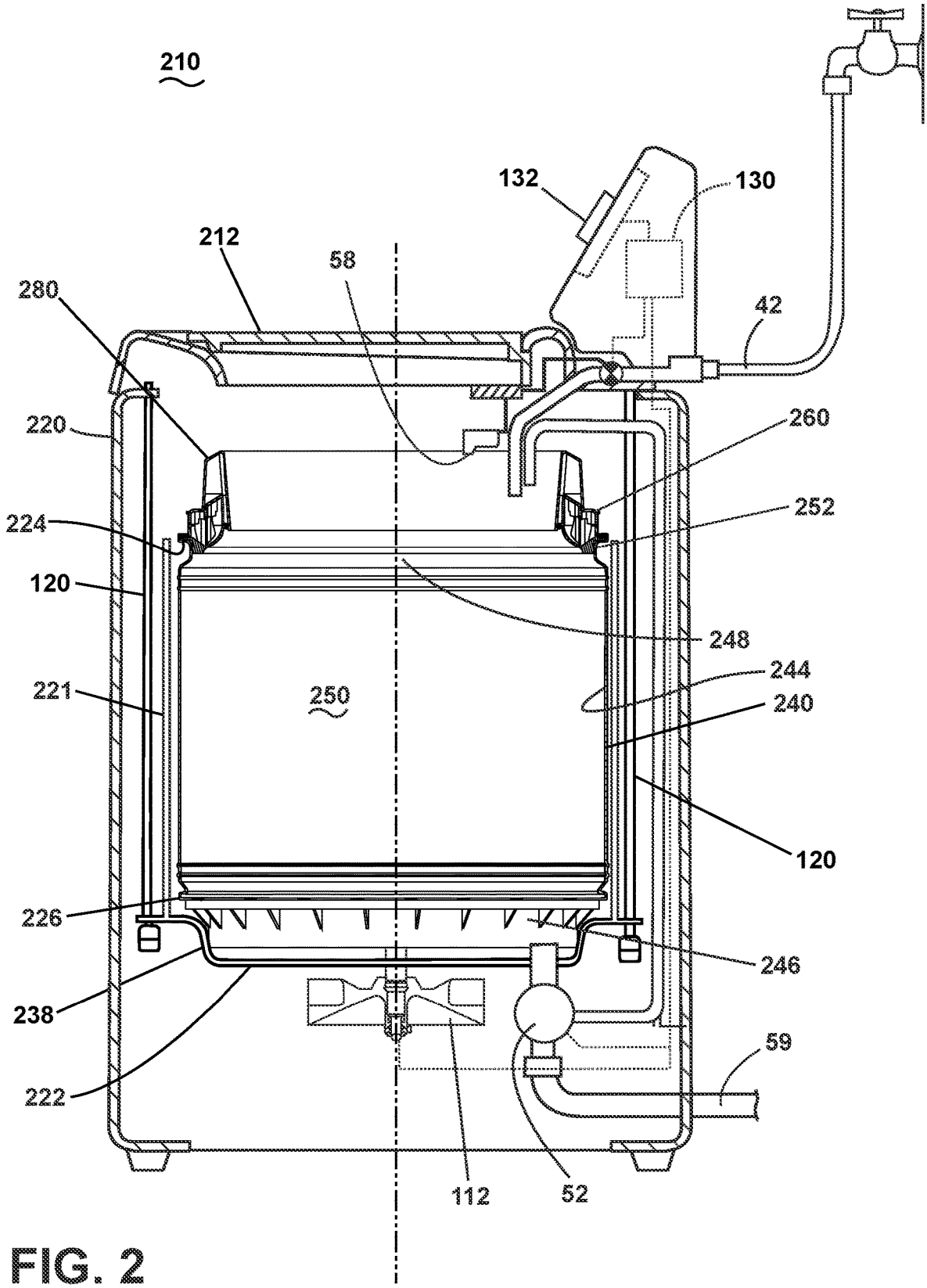
FIG. 2 is a schematic cross-sectional view of a vertical laundry treating appliance including a cabinet supporting a tub that further contains a basket.

Referring to FIG. 2, a laundry treating appliance of the illustrated exemplary vertical axis clothes washer 210, which has many parts and features similar to the laundry treating appliance 10. Therefore, like parts and features will be identified with like numerals increased by 200, with the understanding that the prior description of the laundry treating appliance 10 applies to the clothes washer 210. The clothes washer 210 can include a tub 238 installed in a cabinet 220. The top of the cabinet 220 can include a selectively openable lid 212.

The tub 238 can have any suitable shape, but is illustrated as having a generally cylindrical side or tub peripheral wall 221 closed at its bottom 222 and defining an access opening 224 at its top, which collectively define a tub liquid chamber 226 accessible through the access opening 224. As can be appreciated, the tub 238 can be of a varying height.

A basket 240 can be located within the tub 238 such that a portion extends through the tub access opening 224 and resides within the liquid chamber 226. The basket 240 is mounted relative to the tub 238 for rotation about a basket axis of rotation 242, such as, for example, a central, vertical axis extending through the center of the basket 240. The basket 240 can have a generally cylindrical side or peripheral wall 244 closed at the basket end by a basket bottom 246 and an open top 248 that terminates in a circular upper edge 252, defining a laundry treating chamber 250. A laundry mover, not shown, can be located within the basket 240.

A balancing ring 260 is disposed at the circular upper edge 252 to counterbalance a load imbalance that can occur within the treating chamber during a cycle of operation.

An extension collar 280 can be affixed to the balancing ring 260 to effectively increase the volume of the laundry treating chamber 250. The extension collar 280 provides for adjusting the volume of the laundry treating chamber 250, while negating the need for different height walls for differing baskets 240 to achieve baskets 240 with different volumetric capacities. There can be multiple height extension collars 280 to provide for a variety of different volume treating chambers 250. The extension collars 280 are simpler to manufacture than having multiple baskets 240 with differing wall heights to provide different volumetric capacities. The extension collar need not have any balancing functionality, since the balancing function is provided by the balancing ring, and can be thought of as a non-balancing extension collar.

Figure 3:
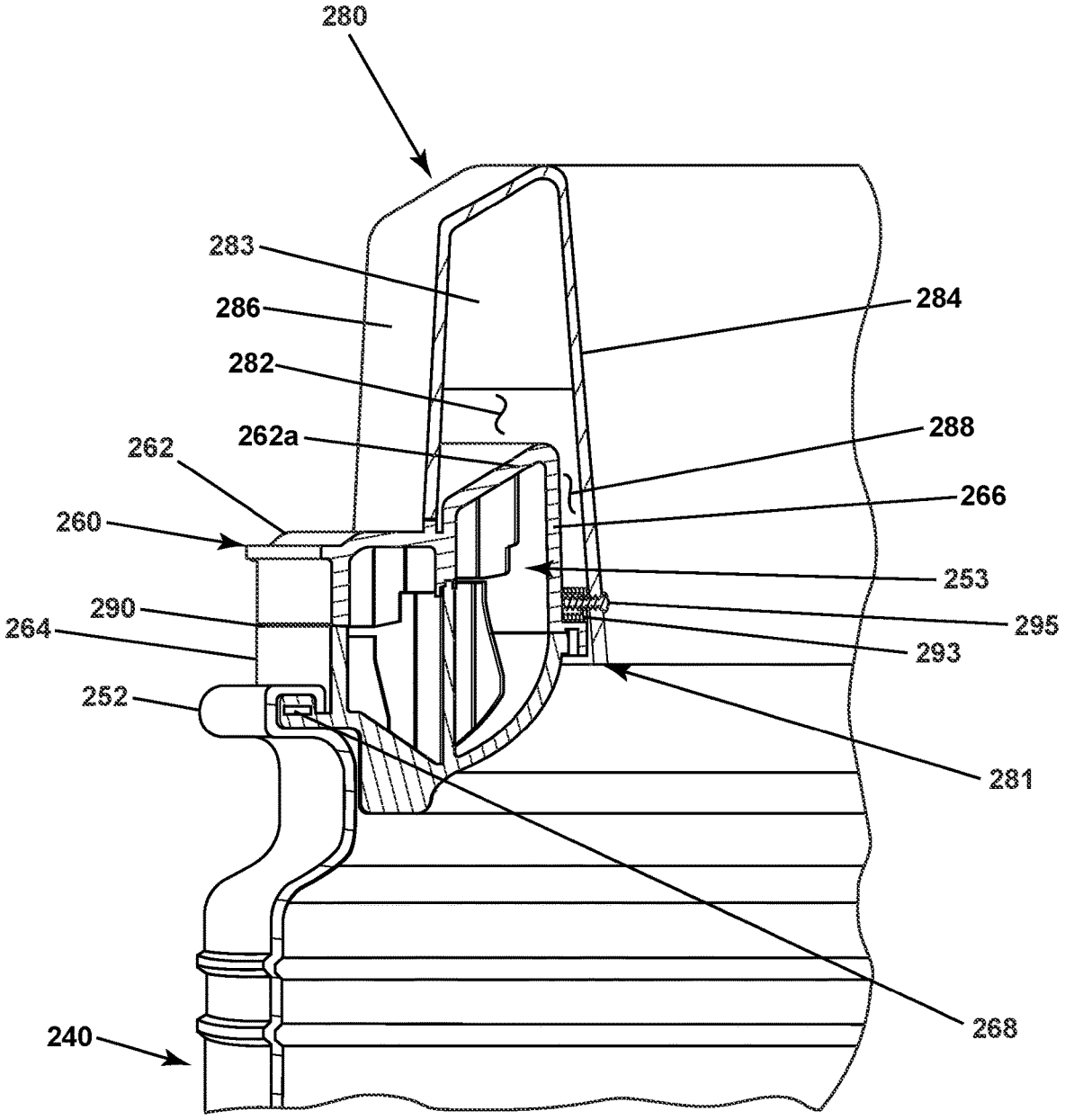
FIG. 3 is a detailed cross-sectional view of the basket of FIG. 2 including a balancing ring and extension collar.

Referring to FIG. 3, the balancing ring 260 can have an interior channel 253 in which at least one of liquid or weights, such as balls, are located, and can move within the channel 253 to counterbalance any imbalance in the laundry within the treating chamber 250. The balancing ring 260 is formed by an upper portion 262, having an upper surface 262*a*, and a lower portion 264, which abut to define a junction 290. The balancing ring has a radial inner surface 265 that defines part of liquid chamber 226 and the access opening 224. The balancing ring 260 also has an annular rib 268 that is crimped by the circular upper edge 252 to couple the balancing ring 260 to the basket 240.

The extension collar 280 has a lower end 281 that is shaped to received a portion of the balancing ring to affect the mounting of the extension collar 280 to the balancing ring 260. In one example, the extension collar 280 includes a channel 282, which receives a portion of the balancing ring 260 to at least partially couple the extension collar 280 to the balancing ring 260. The channel 282 is formed by a radial inner leg 284, which is radially spaced from a radial outer leg 286. A lower portion 288 of the channel 282 is created by terminal edges of the radial inner leg 284 and radial outer leg 286. The lower portion 288 overlies, abuts, or is supported at the balancing ring upper portion 262. A plurality of annularly spaced baffles or ribs 283 can span an upper portion of the channel 282 to provide strength to the extension collar 280, with the lower portion 288 located below the ribs 283. As illustrated, the radial inner and outer legs, 284, 286 taper toward each other in a direction away from the balancing ring 260. However, the radial inner and outer legs 284, 286 need not have any relative taper.

The extension collar 280 is secured to the balancing ring 260 by any number of known fastening techniques including press-fit, detents, bonding, and mechanical fasteners. For mechanical fastening, screw bosses 293 can be molded into either the extension collar 280 or the balancing ring 260 to receive a screw 295. The screw 295 can pass through either of the radial inner leg 284 or the radial outer leg 286, or both. Alternatively, or in combination with the mechanical fasteners, clips or detents can be formed on the lower portion 288 of the extension collar 280 to engage a suitable receiving feature on the balancing ring 260. While described as integral with at least one of the balancing ring 260 or extension collar 280, the clip can be physically separate from both the balancing ring 260 or extension collar 280. In another alternative, commonly known adhesives suitable for the material types of the extension collar 280 and balancing ring 260 can be used to create a permanent bond. The extension collar 280 can also be welded to the balancing ring 260. For example, the lower end of the radial outer leg 286 can rest on the upper surface 262*a* of balancing ring upper portion 262 and/or be welded to the upper surface 262*a*.

Figure 4:
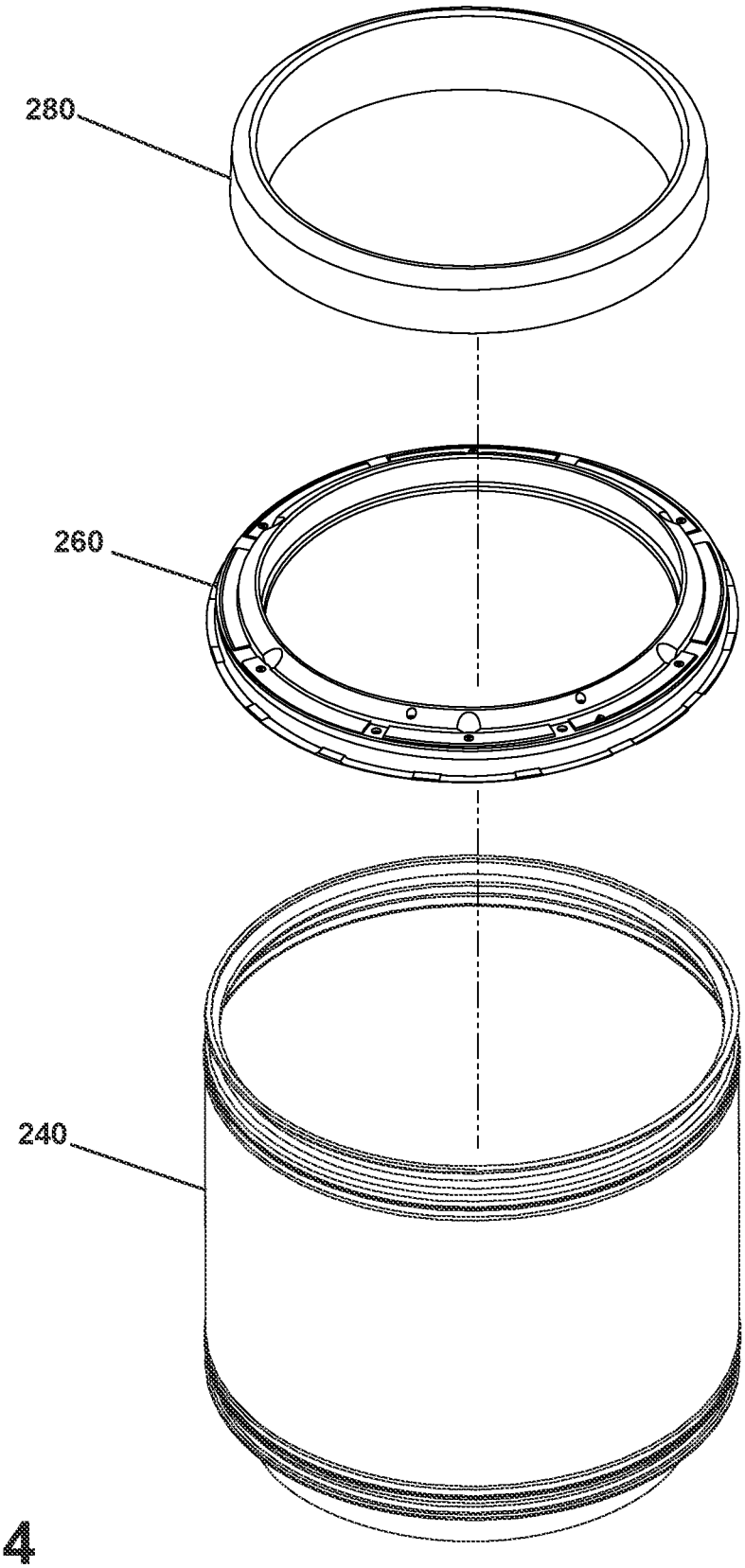
FIG. 4 is an exploded view of the components of FIG. 3.

Referring to FIG. 4, an exploded view of the extension collar 280, balancing ring 260, and basket 240 is illustrated. During the assembly of the laundry treating appliance, the basket 240 and balancing ring 260 are normally assembled as a sub-assembly, which is then suspended from the cabinet. The basket sub-assembly can also include the tub 238 and a suitable movement system 110, which collectively is referred to as the wash unit. The extension collar 280 can be added to the basket sub-assembly. Alternative, the extension can be added to the balancing ring after the basket sub-assembly is suspended within the cabinet.

Basket capacity is typically measured to the highest point on the balancing ring 260, but the addition of the extension collar 280 enables the highest point to be changed more easily than conventional assembly methods that simply accommodate different basket sizes to increase capacity. The extension collar 280 can also be made of different colors or shapes to help differentiate between different product configurations. While described in terms of a vertical axis appliance, the extension collar 280 has applicability to a horizontal axis appliance. The horizontal axis appliance has a drum, instead of the basket, with the balancing ring mounted at the front edge of the drum. The extension collar 280 can be mounted to the balancing ring of the horizontal axis appliance in the same manner as described for the vertical axis appliance.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. For example, while the extension collar is shown mounted to the balancing ring, which is mounted to an upper edge of the container and/or basket, the extension could be mounted directly to the container/basket, especially when a balancing ring is not present. The extension could be directly secured, using any of the disclosed methods, to the container/basket.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

Further aspects of the disclosure are provided by the subject matter of the following clauses:

A clothes washer comprising a cabinet defining a cabinet interior; a tub located within the cabinet interior and defining a liquid chamber having a tub access opening; a suspension coupling the tub to the cabinet; a basket located within the liquid chamber and defining a laundry treating chamber having a basket access opening; a balancing ring circumscribing the basket access opening; and an extension collar circumscribing at least a portion of the balancing ring and projecting beyond the balancing ring to increase an effective volume of the basket.

The clothes washer of the preceding clause wherein the extension collar has a channel in which at least a portion of the balancing ring is received.

The clothes washer of any of the preceding clauses wherein the extension collar has a radial inner leg defining a portion of the channel.

The clothes washer of any of the preceding clauses wherein the balancing ring includes a radial inner surface and the radial inner leg overlies at least a portion of the radial inner surface.

The clothes washer of any of the preceding clauses wherein the radial inner leg overlies all of the radial inner surface.

The clothes washer of any of the preceding clauses wherein the balancing ring comprises a junction and the radial inner leg overlies or abuts the junction.

The clothes washer of any of the preceding clauses wherein the extension collar includes a radial outer leg, radially spaced from the radial inner leg, with the radial outer leg further defining a portion of the channel.

The clothes washer of any of the preceding clauses wherein the radial outer leg overlies at least a portion of the balancing ring.

The clothes washer of any of the preceding clauses wherein the radial outer leg terminates in an edge that rests on a portion of the balancing ring.

The clothes washer of any of the preceding clauses wherein the radial inner leg and radial outer leg taper inwardly toward each other in a direction away from the balancing ring.

The clothes washer of any of the preceding clauses wherein the extension collar has a lower end shaped to receive at least a portion of the upper portion of the balancing ring.

The clothes washer of any of the preceding clauses wherein a portion of the extension collar abuts an upper surface of the upper portion of the balancing ring.

The clothes washer of any of the preceding clauses wherein the extension collar is secured to the balancing ring.

The clothes washer of any of the preceding clauses wherein the extension collar is bonded to the balancing ring to affect the securing of the extension collar to the balancing ring.

The clothes washer of claim 14 further comprising mechanical fasteners securing the extension collar to the balancing ring.

A clothes washer comprising a cabinet defining a cabinet interior; a tub located within the cabinet interior and defining a liquid chamber having a tub access opening; a container located within the liquid chamber and defining at least a part of a laundry treating chamber having a treating chamber or basket access opening; and a non-balancing extension collar coupled to the container to increase an effective volume of the laundry treating chamber.

The clothes washer of the preceding clause wherein the container has an edge defining the access opening and the non-balancing extension collar is coupled to the edge.

The clothes washer of any of the preceding clauses wherein the non-balancing extension collar comprises a radial inner leg, which defines a portion of the laundry treating chamber.

The clothes washer of any of the preceding clauses wherein the non-balancing extension collar comprises a lower end configured to couple to the container.

The clothes washer of any of the preceding clauses wherein the non-balancing extension collar is secured to the container.

The clothes washer of any of the preceding clauses further comprising a mechanical fastener securing the non-balancing extension collar to the container.

What is claimed is:

1. A clothes washer comprising:

a cabinet defining a cabinet interior;

a tub located within the cabinet interior and defining a liquid chamber having a tub access opening;

a suspension coupling the tub to the cabinet;

a basket located within the liquid chamber and defining a laundry treating chamber having a basket access opening;

a balancing ring circumscribing the basket access opening; and an extension collar provided with the balance ring, the extension collar circumscribing at least a portion of the balancing ring, and wherein the extension collar projects beyond the balancing ring and is configured to increase an effective volume of the basket.

2. The clothes washer of claim 1 wherein the extension collar has a channel in which at least the portion of the balancing ring is received.

3. The clothes washer of claim 2 wherein the extension collar has a radial inner leg defining a portion of the channel.

4. The clothes washer of claim 3 wherein the balancing ring includes a radial inner surface and the radial inner leg overlies at least a portion of the radial inner surface.

5. The clothes washer of claim 4 wherein the radial inner leg overlies all of the radial inner surface.

6. The clothes washer of claim 3 wherein the balancing ring comprises a junction and the radial inner leg overlies or abuts the junction.

7. The clothes washer of claim 3 wherein the extension collar includes a radial outer leg, radially spaced from the radial inner leg, with the radial outer leg further defining the portion of the channel.

8. The clothes washer of claim 7 wherein the radial outer leg overlies at least the portion of the balancing ring.

9. The clothes washer of claim 8 wherein the radial outer leg terminates in an edge that rests on the portion of the balancing ring.

10. The clothes washer of claim 7 wherein the radial inner leg and radial outer leg taper inwardly toward each other in a direction away from the balancing ring.

11. The clothes washer of claim 1 wherein the extension collar has a lower end shaped to receive at least a portion of an upper portion of the balancing ring.

12. The clothes washer of claim 11 wherein a portion of the extension collar abuts an upper surface of the upper portion of the balancing ring.

13. The clothes washer of claim 1 wherein the extension collar is secured to the balancing ring.

14. The clothes washer of claim 13 wherein the extension collar is bonded to the balancing ring to affect securing of the extension collar to the balancing ring.

15. The clothes washer of claim 14, further comprising mechanical fasteners securing the extension collar to the balancing ring.

16. A clothes washer comprising:

a cabinet defining a cabinet interior;

a tub located within the cabinet interior and defining a liquid chamber having a tub access opening;

a suspension coupling the tub to the cabinet;

a basket located within the liquid chamber and defining a laundry treating chamber having a basket access opening;

a balancing ring circumscribing the basket access opening; and an extension collar including a radial inner leg, the extension collar circumscribing at least a portion of the balancing ring and projecting beyond the balancing ring to increase an effective volume of the basket, wherein the extension collar has a channel in which at least the portion of the balancing ring is received and wherein the radial inner leg defines at least a portion of the channel.

17. A clothes washer comprising:

a cabinet defining a cabinet interior;

a tub located within the cabinet interior and defining a liquid chamber having a tub access opening;

a suspension coupling the tub to the cabinet;

a basket located within the liquid chamber and defining a laundry treating chamber having a basket access opening;

a balancing ring circumscribing the basket access opening; and an extension collar circumscribing at least a portion of the balancing ring and projecting beyond the balancing ring to increase an effective volume of the basket; and wherein the extension collar is bonded to the balancing ring to affect securing of the extension collar to the balancing ring or wherein the extension collar has a lower end shaped to receive at least a portion of an upper portion of the balancing ring, a portion of the extension collar abutting an upper surface of the upper portion of the balancing ring.

18. The clothes washer of claim 17, further comprising mechanical fasteners securing the extension collar to the balancing ring.

19. The clothes washer of claim 17, wherein the extension collar has a channel in which at least the portion of the balancing ring is received and wherein a radial inner leg defines at least a portion of the channel.

* * * * *